US010727012B2

(12) United States Patent
Malingowski et al.

(10) Patent No.: US 10,727,012 B2
(45) Date of Patent: Jul. 28, 2020

(54) MOLDED CASE CIRCUIT INTERRUPTER HAVING CIRCUITRY COMPONENT SITUATED ADJACENT REAR EXTERIOR SURFACE

(71) Applicant: EATON INTELLIGENT POWER LIMITED, Dublin (IE)

(72) Inventors: Richard Paul Malingowski, McDonald, PA (US); Theodore J. Miller, Oakdale, PA (US); Kelly Julia McCarthy, Pittsburgh, PA (US); David Rohn, Venetia, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/131,514

(22) Filed: Sep. 14, 2018

(65) Prior Publication Data

US 2020/0090888 A1 Mar. 19, 2020

(51) Int. Cl.
*H01H 21/04* (2006.01)
*H01H 21/22* (2006.01)
(Continued)

(52) U.S. Cl.
CPC ..... *H01H 21/04* (2013.01); *H01H 21/22* (2013.01); *H01H 71/025* (2013.01); *H01H 71/528* (2013.01); *H01H 2221/016* (2013.01)

(58) Field of Classification Search
CPC ..... H01H 9/02; H01H 21/04; H01H 21/22; H01H 71/025; H01H 71/528; H01H 89/00; H02B 1/26
(Continued)

(56) References Cited

U.S. PATENT DOCUMENTS 6,204,465 B1 * 3/2001 Gula ..... H01H 77/105 218/154
6,642,460 B2 * 11/2003 Dunne ..... H01H 1/5805 200/292

(Continued)

FOREIGN PATENT DOCUMENTS

CN 106229228 A 12/2016
CN 106783419 A 5/2017

OTHER PUBLICATIONS

European Patent Office, "extended European search report", EP 19197421.1, dated Jan. 9, 2020, 7 pp.

*Primary Examiner* — William A Bolton
(74) *Attorney, Agent, or Firm* — Eckert Seamans Cherin & Mellott, LLC

(57) ABSTRACT

A molded case circuit interrupter advantageously employs a circuitry component that is situated adjacent a rear exterior surface of the molded case of the molded case circuit interrupter. Previous circuit interrupters have sometimes employed a non-conductive backsheet of a nominal thickness of 0.062 inches that was adhered to the rear surface of the molded case circuit interrupter in order to electrically isolate screws, posts, and the like that were mounted to and that were exposed on the rear portion of a molded case thereof. The disclosed and claimed concept provides a circuitry component in place of or in addition to the back sheet, with the circuitry component including flexible ribbons having electrical conductors that extend through holes formed in the molded case and that are electrically connected with electronic components that are situated within the interior of the molded case.

11 Claims, 9 Drawing Sheets

(51) Int. Cl.
*H01H 71/02* (2006.01)
*H01H 71/52* (2006.01)

(58) Field of Classification Search
USPC ..... 200/292, 293, 51.03, 11 D; 335/199
See application file for complete search history.

(56) References Cited

U.S. PATENT DOCUMENTS

| | | | | |
|---|---|---|---|---|
| 6,678,946 | B2 * | 1/2004 | Serizawa | H05K 3/0064 29/830 |
| 6,924,439 | B1 * | 8/2005 | Bonni | H05K 1/118 174/254 |
| 7,358,836 | B2 * | 4/2008 | Carlino | H01H 71/123 335/202 |
| 9,524,842 | B2 * | 12/2016 | Sisley | H01H 71/0207 |
| 9,844,143 | B2 * | 12/2017 | Utz | H05K 3/325 |
| 2010/0149772 | A1 | 6/2010 | Gass et al. | |
| 2016/0111230 | A1 * | 4/2016 | Fonseca | H01H 9/0271 361/93.6 |
| 2017/0110281 | A1 | 4/2017 | Lathrop et al. | |

* cited by examiner

MOLDED CASE CIRCUIT INTERRUPTER HAVING CIRCUITRY COMPONENT SITUATED ADJACENT REAR EXTERIOR SURFACE

BACKGROUND

The disclosed and claimed concept relates generally to circuit interrupters and, more particularly, to a molded case circuit interrupter having a circuitry component situated adjacent a rear exterior surface of the molded case.

RELATED ART

Numerous types of circuit interruption devices are known in the relevant art. It has been known to employ on other molded case circuit interrupters a thermal-magnetic tripping system to trigger a set of separable contacts of the circuit interrupter to move between a CLOSED condition and an OPEN condition, such as in the event of an overcurrent condition or other such condition. It is also understood, however, that newer circuit interrupters sometimes employ electronically-controlled tripping mechanisms instead of the conventional thermal-magnetic tripping systems. While such newer systems are more accurate and provide better results, they can require lots of data processing capability, which requires processor equipment that occupies space. The space within the interior regions of the circuit interrupter typically is occupied by the circuit interrupter mechanism itself, which can include accessories such as shunt trips, auxiliary switches, under-voltage relays, bell alarms, and the like without limitation. Accordingly, space within the interior of a circuit interrupter is typically scarce, whereupon data processing capability to operate such electronic components is likewise typically scare. Improvements thus would be desirable.

SUMMARY

Accordingly, an improved molded case circuit interrupter advantageously employs a circuitry component that is situated adjacent a rear exterior surface of the molded case of the molded case circuit interrupter. Previous circuit interrupters have sometimes employed a non-conductive backsheet of a nominal thickness of 0.062 inches that was adhered to the rear surface of the molded case circuit interrupter in order to electrically isolate screws, posts, and the like that were mounted to and that were exposed on the rear portion of a molded case thereof. The disclosed and claimed concept provides a circuitry component in place of or in addition to the back sheet, with the circuitry component including flexible ribbons having electrical conductors that extend through holes formed in the molded case and that are electrically connected with electronic components that are situated within the interior of the molded case.

Accordingly, an aspect of the disclosed and claimed concept is to provide a molded case circuit interrupter having a circuitry component that is situated adjacent an exterior surface of a molded case of the molded case circuit interrupter.

Another aspect of the disclosed and claimed concept is to provide such a molded case circuit interrupter having a circuitry component situated adjacent an exterior surface of the circuit interrupter that is electrically connected with a number of electronic components that are situated within an interior region of the circuit interrupter.

Another aspect of the disclosed and claimed concept is to provide such a circuit interrupter having a circuitry component that is situated at the exterior of the circuit interrupter and that provides additional data processing capability that can be used by the components that are situated within the interior of the circuit interrupter.

These and other aspects of the disclosed and claimed concept are provided by an improved molded case circuit interrupter, the general nature of which can be stated as including a molded case that can be generally stated as including a first case portion and a second case portion, the molded case having an interior region formed therein that is situated between the first and second case portions, an electrical apparatus situated on the molded case, the electrical apparatus can be generally stated as including a set of separable electrical contacts situated within the interior region, a handle that is structured to at least initiate movement of the set of separable contacts between an OPEN condition and a CLOSED condition, and a circuitry component, the molded case having an exterior surface opposite the interior region, the exterior surface can be generally stated as including a front exterior surface and a rear exterior surface that face in opposite directions away from one another, the handle being situated adjacent the front exterior surface, the circuitry component can be generally stated as including a substrate situated adjacent the rear exterior surface and further can be generally stated as including a number of electronic components situated on the substrate, and the substrate can be generally stated as including a number of electrical conductors and a support, the number of electrical conductors being situated on the support, the support being formed of an electrically insulative material, at least some of the electronic components of the number of electronic components being electrically connected with at least some of the electrical conductors of the number of electrical conductors.

BRIEF DESCRIPTION OF THE DRAWINGS

A further understanding of the disclosed and claimed concept can be gained from the following Description, when read in conjunction with the accompanying drawings in which:

Similar numerals refer to similar parts throughout the specification.

DESCRIPTION

An improved circuit interrupter 4 in accordance with a first embodiment of the disclosed and claimed concept is depicted generally in FIGS. 1-3 and 6-7. The circuit interrupter 4 in the depicted exemplary embodiment is a molded ease circuit interrupter that can be said to include a molded case 6 and an electrical apparatus 8 that is situated on the molded case 6. As will be set forth in greater detail below, the electrical apparatus 8 advantageously provides a data processing capability that, is situated at and that is performed at the exterior of the molded case 6 and that provides such, data processing capability to components that are situated internal to the molded case 6.

Figure 1:
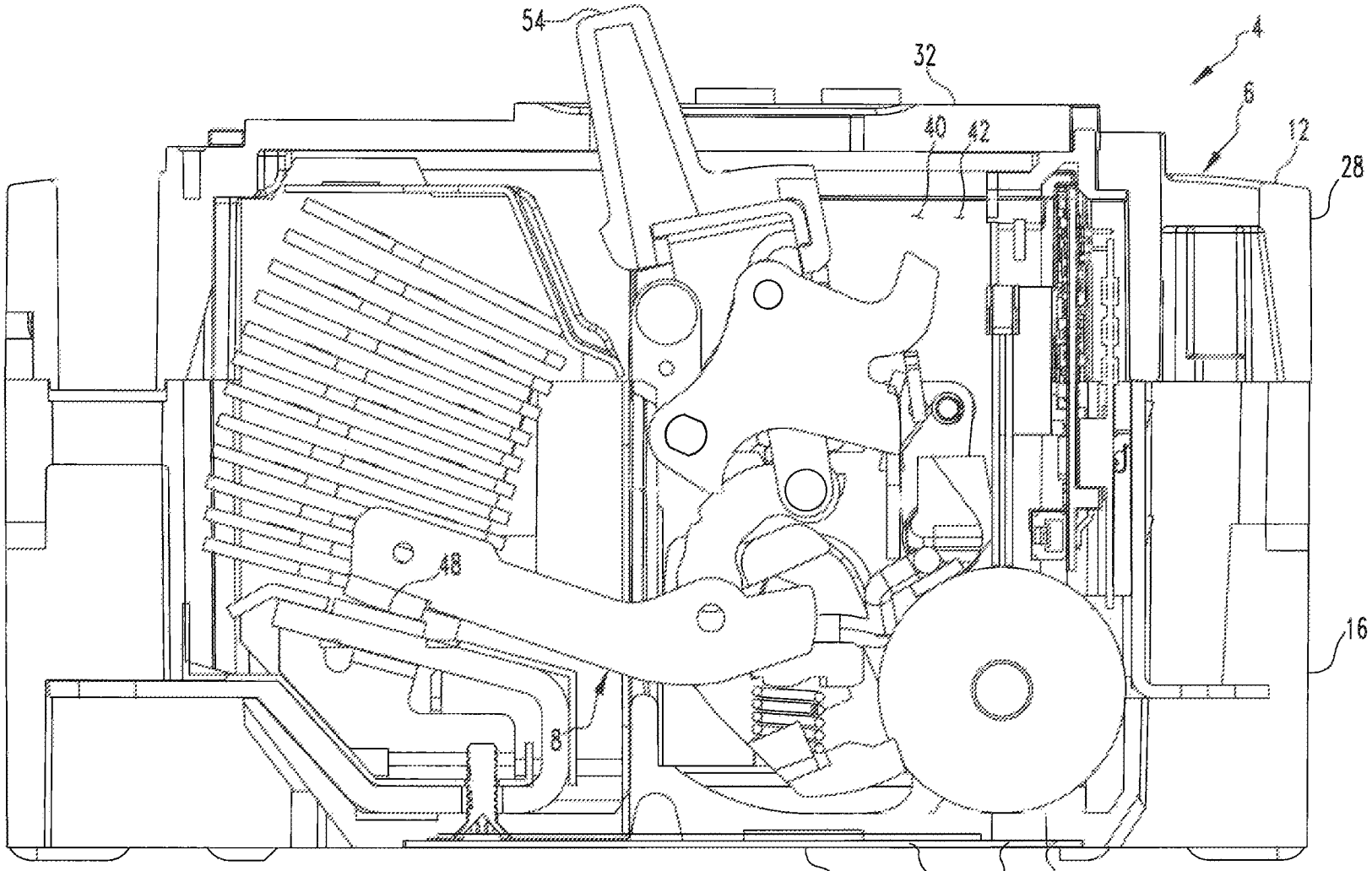
FIG. 1 is a depiction of an improved circuit interrupter in accordance with a first embodiment of the disclosed and claimed concept and with a set of separable contacts thereof being in a CLOSED condition.
Figure 2:
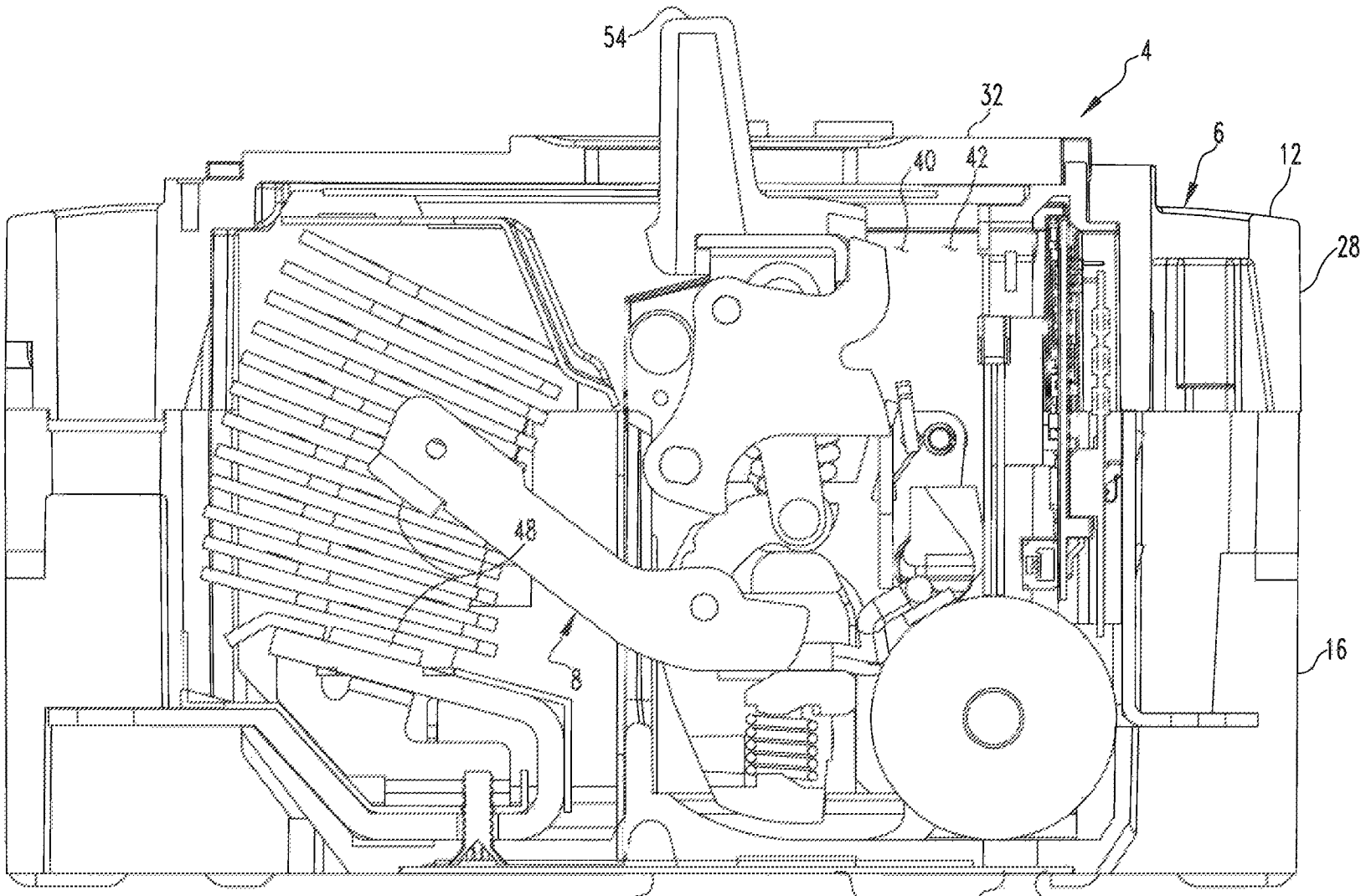
FIG. 2 is a view similar to FIG. 1, except depicting the set of separable contacts in an OPEN condition.
Figure 3:
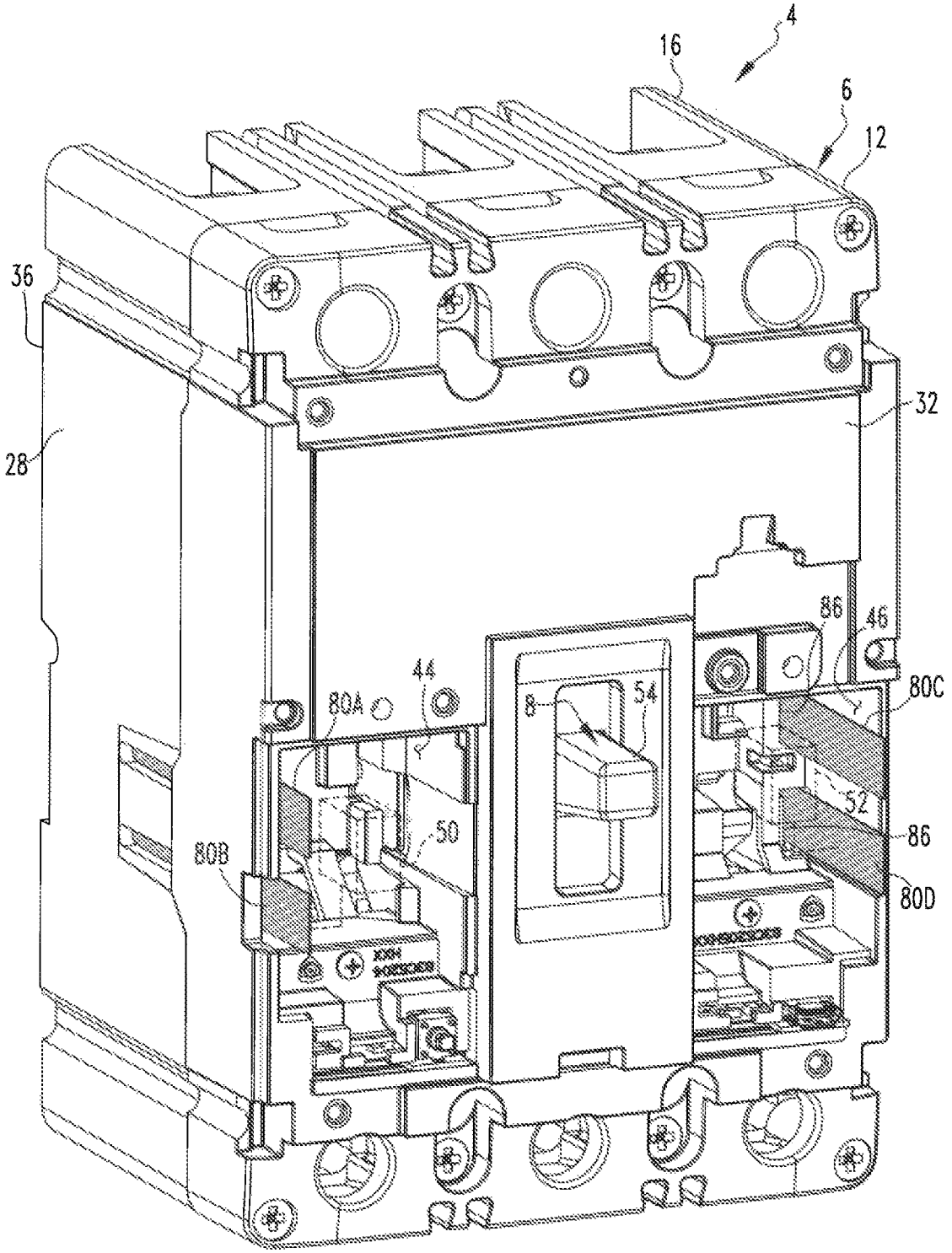
FIG. 3 is a perspective view of the circuit interrupter of FIG. 2.
Figure 4:
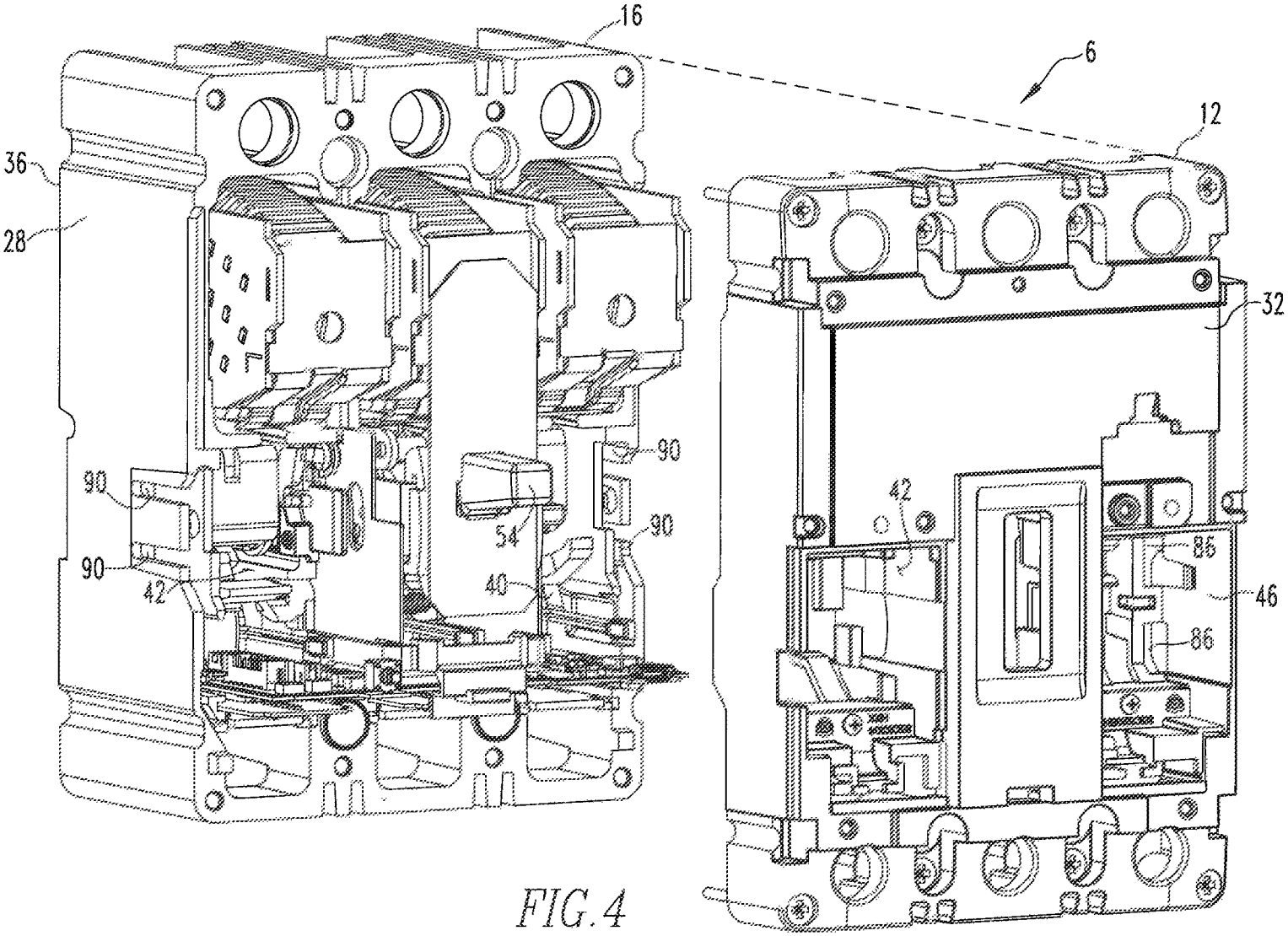
FIG. 4 is an exploded view of a front case portion, a rear case portion, and a portion of an electrical apparatus of the circuit interrupter of FIG. 3.

As can be understood from FIGS. 3 and 4, the molded case 6 can be said to include a front case portion 12 and a rear case portion 16, both of which are molded from an insulative plastic material or other appropriate material. The molded case 6 can be said to have an exterior surface 28 that includes a front exterior surface 32 situated on the front case portion 12 and a rear exterior surface 36 (FIG. 6) that is situated on the rear case portion 16. In the depicted exemplary embodiment, the front and rear exterior surfaces 32 and 36 face in opposite directions away from one another.

The molded case 6 additionally includes an interior region 40, at least a portion of which is situated between the front and rear case portions 12 and 16. More specifically, the interior region 40 includes a main internal cavity 42 that is situated between the front and rear case portions 12 and 16. The front case portion 12 further has a first accessory cavity 42 and a second accessory cavity 46 formed internally therein that may or may not be in communication with the main internal cavity 42. In the depicted exemplary embodiment, the first and second accessory cavities 44 and 46 are separate from and are not in communication with the main internal cavity 42 yet are internal to the front case portion 12. The first and second accessory cavities 44 and 46 may be considered to be a part of the interior region 40 but need not necessarily be so considered.

The electrical apparatus 8 can be said to include a set of separable contacts 48 that are situated within the main internal cavity 42 of the internal region 40. The set of separable contacts 48 are connectable with line and load conductors and are movable between a CLOSED condition, such as in FIG. 1, and an OPEN condition, such as in FIG. 2. As can be understood, the electrical apparatus 8 further includes an operating, mechanism that is connected with a handle 54 that moves the set of separable contacts 48 between the CLOSED and OPEN conditions. The handle 54 protrudes from the front exterior surface 32 and is operable to at least initiate movement of the set of separable contacts 48 between the CLOSED and OPEN conditions.

In the depicted exemplary embodiment, the circuit interrupter 4 includes, as is depicted schematically in FIG. 3, a first accessory 50 that is situated in the first accessory cavity 44, and a second accessory 52 that is situated in the second accessory cavity 46. As will be described in greater detail below, the first and second accessories 50 and 52 are electronic components or electro-mechanical components that are electrically connected with the electrical apparatus 8 and to which data processing capability is remotely provided from a location adjacent the rear exterior surface 36. The first and second accessories 50 and 52 are depicted in a schematic fashion in the accompanying drawings. The first and second accessories 50 and 52 can each provide, for example, auxiliary functionality such as shunt trip functionality, auxiliary switch functionality, under-voltage relay functionality, bell alarm functionality, and the like without limitation. Additionally or alternatively, either or both of the first and second accessories 50 and 52 could include a user interface that might include an LCD or other visual display, one or more physical or virtual buttons, a Universal Serial Bus (USB) that is situated on or adjacent the front exterior surface 32.

Figure 5:
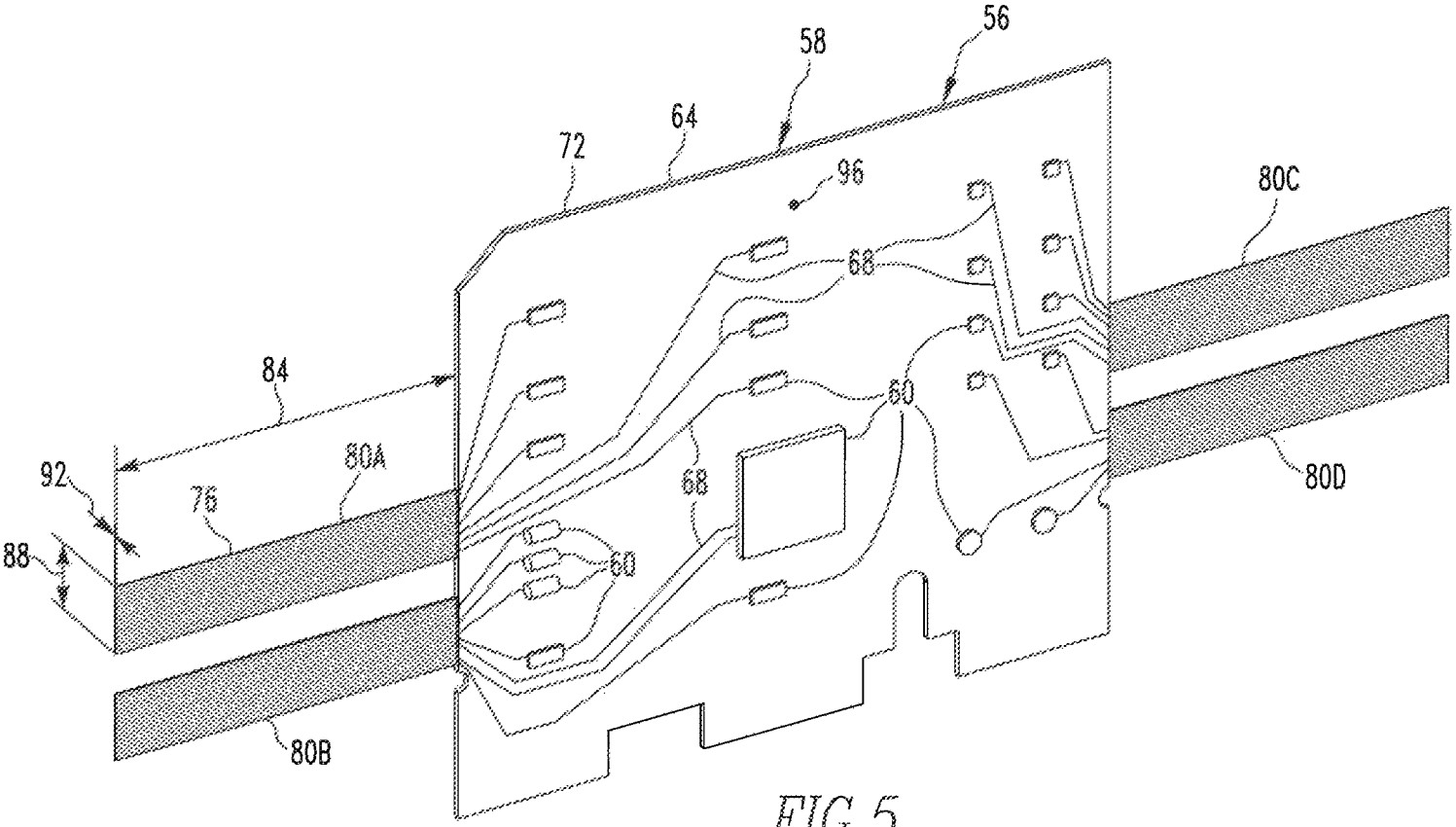
FIG. 5 is a circuitry component of the circuit interrupter of FIG.
Figure 6:
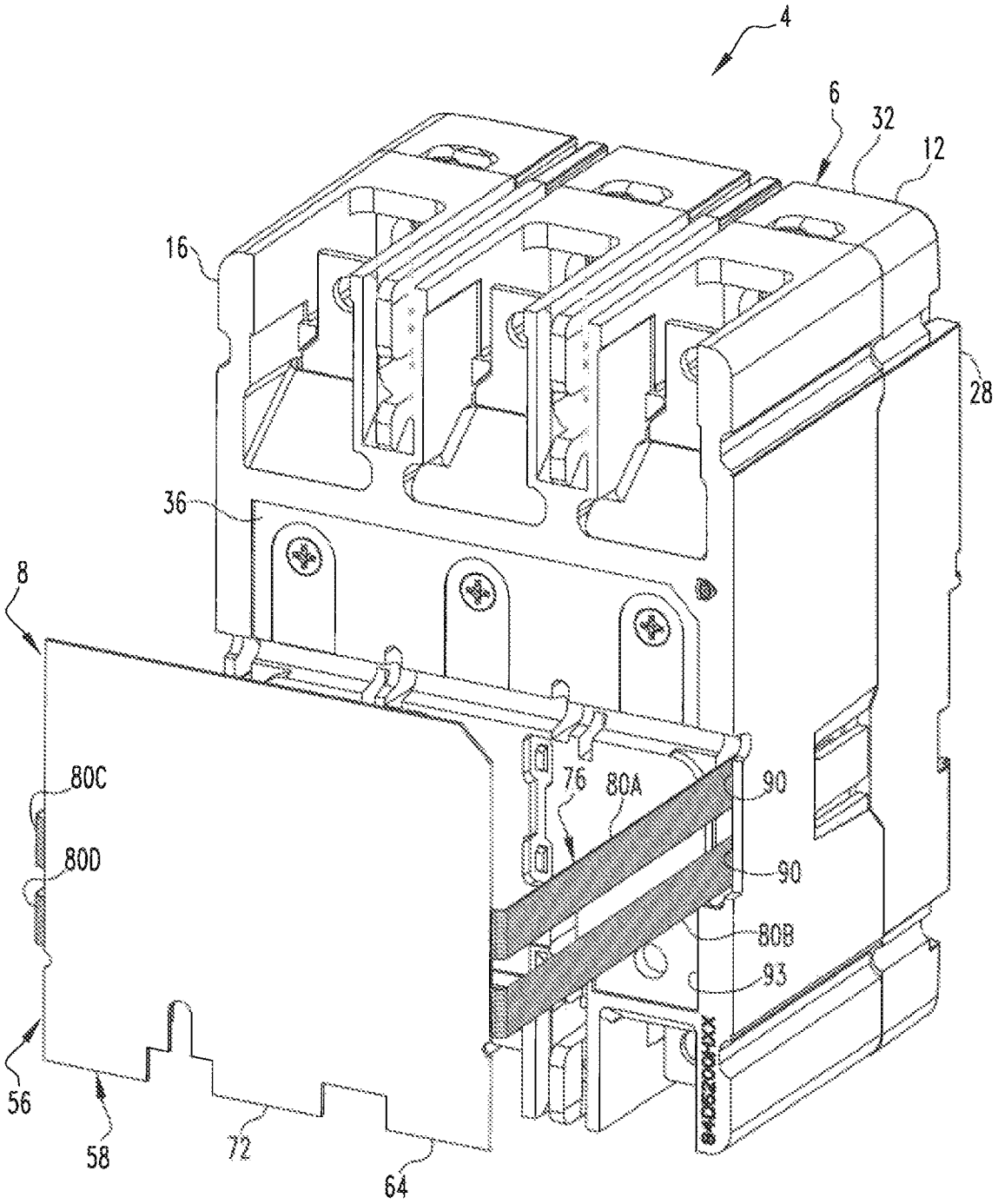
FIG. 6 is a rear view of the circuit interrupter of FIG. 3 with the circuitry component being exploded away from a molded case of the circuit interrupter.

The electrical apparatus 8 includes, a circuitry component 56 that is generally depicted in FIG. 5 and which is situated on the molded case 6 when the circuit interrupter 4 is fully assembled. The circuitry component 56 includes a substrate 58 that is situated adjacent the rear exterior surface 36 and further includes a number of electronic components 60 that are situated on the substrate 58. As employed herein, the expression "a number of" and variations thereof shall refer broadly to any non-zero quantity, including a quantity of one. The substrate 58 can be said to include a support 64 that is formed of an insulative material and to further include a number of electrical conductors 68 that are situated on the support. The number of electrical conductors 68 are electrically connected with the number of electronic components 60. The number of electronic components 60 can include a processor, memory, and other electronic components that are suited to perform data processing operations. As a general matter, the memory will have stored therein a number of instructions in the form of routines which, when executed on the processor, perform various operations that may be communicated to the first and second accessories 50 and 52 and which together cause the circuit interrupter 4 to perform various operations.

As is best shown in FIG. 5, the substrate 58 can be said to include a main portion 72 and a ribbon portion 76, wherein the ribbon portion 76 includes a plurality of ribbons that are indicated at the numerals 80A, 80B, 80C, and 80D, and which may be collectively or individually referred to herein with the numeral 80. The ribbons 80 and the main portion 72 are formed of a flexible insulative material and are co-formed as a single piece unit from a single sheet of insulative material. In the depicted exemplary embodiment, at least some of the electrical conductors of the number of electrical conductors 68 extend along the ribbons 80 of the ribbon portion 76 to communicate data signals between the number of electronic components 60 that are situated on the main portion 72 and the first and second accessories 50 and 52. As can be understood from FIG. 5, the exemplary ribbons 80 are each of a length 84, a width 88, and a thickness 92, with the length 84 and width 88 each being substantially greater than the thickness 92, and with the length 84 being substantially greater than the width 88. As such, the ribbons 80 are each of a form factor that is of a thin, flexible, and ribbon-like shape. It is understood, however, that the exemplary ribbons 80 can be replaced with cables, interconnecting printed circuit boards, or other conductive structures without departing from the spirit of the instant disclosure.

Figure 7:
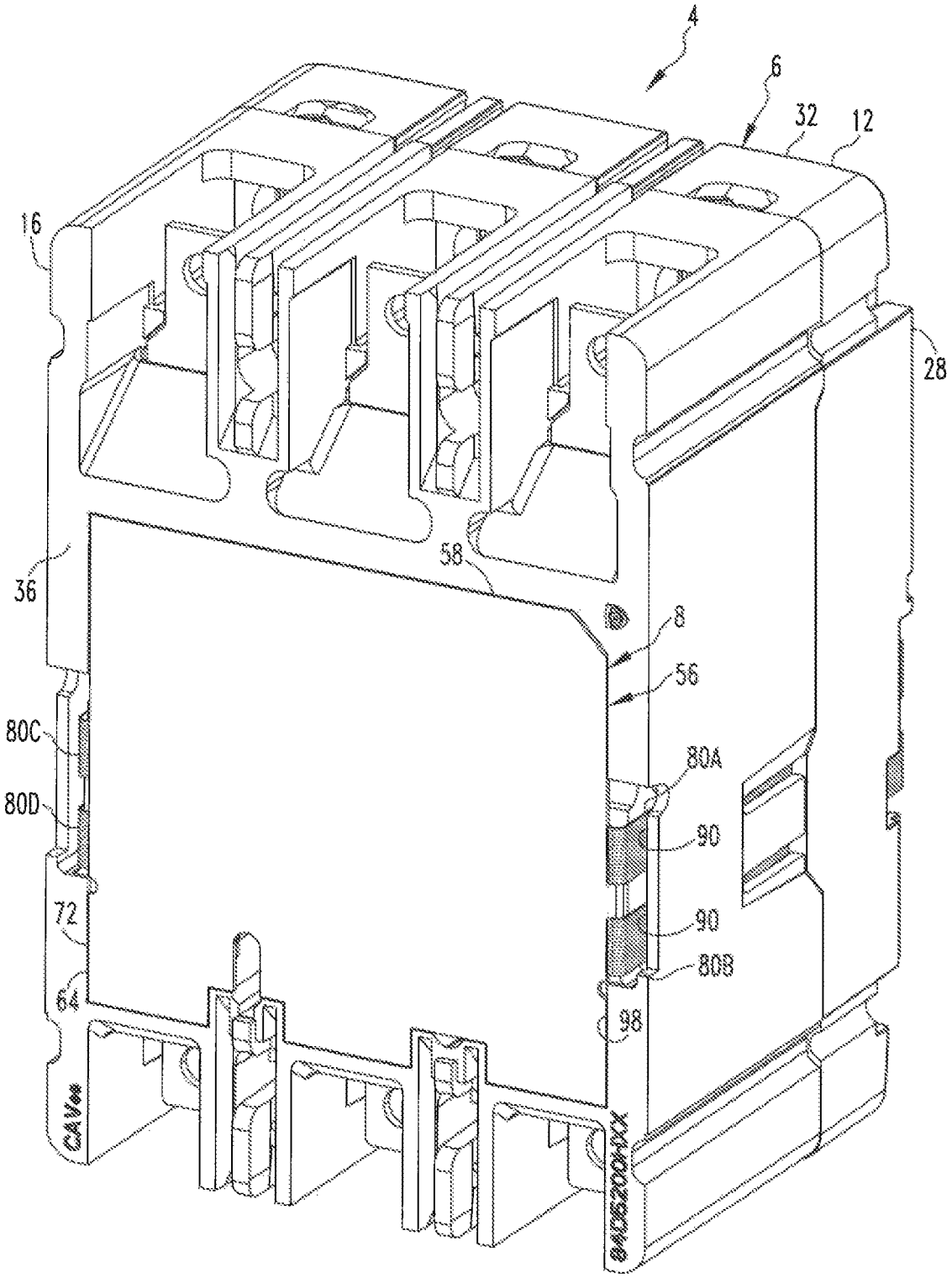
FIG. 7 is an assembled view of the circuit interrupter of FIG. 6.

As can be understood from FIGS. 3-4 and 6-7, the molded case 6 has a number of front holes 86 that are formed in the front case portion 12 and a number of rear holes 90 that are formed in the rear case portion 16, such as is shown in FIG. 7. In the depicted exemplary embodiment, the ribbons 80A and 808 extend from the main portion 72 of the support 64 through a pair of the rear holes 90 and then through a pair of the front holes 86 in order to terminate at the first accessory cavity 44. In a like fashion, the ribbons 80C and 80D extend from the main portion 72 through another pair of the rear holes 90 and then through another pair of the front holes 86 to terminate in the second accessory cavity 46. In the depicted exemplary embodiment, at least one of the ribbons 80A and 808 is electrically connected with the first accessory 50, and at least one of the ribbons 80C and 80D is electrically connected with the second accessory 52. It is understood, however, that other electrical connections are possible between the ribbons 80 and the various accessories that might be situated in the first and second accessory cavities 44 and 46.

As can be understood from FIG. 5, the electrical apparatus 8 includes an amount of adhesive 96 that is applied to the substrate 58 in order to adhere and thus affix the circuitry component 56 to the molded case 6. For example, FIG. 7 depicts the substrate 58 being adhered to and affixed to the rear case portion 16 adjacent the rear exterior surface 36. In such a condition, the ribbons 80 extend through the rear holes 90 and through the front holes 86 and terminate in the first and second accessory cavities 44 and 46 as noted above. In such a condition, the circuitry component 56 and, more specifically, the number of electronic components 60, are situated at the exterior of the molded case 6, and are more specifically situated adjacent the rear exterior surface 36 thereof, and thus do not occupy any space within the interior region 40. However, the processing capability provided by the circuitry component 56 is electronically communicated with the exemplary first and second accessories 50 and 52 which are themselves electronically connected with other componentry of the electrical apparatus 8 and are operable to perform operations such as tripping the circuit interrupter 4, activating alarms, and the like depending upon the particular function of the first and second accessories 50 and 52. By situating the substrate 58 and thus the number of electronic components 60 at the exterior of the molded case 6, i.e., adjacent the rear exterior surface 36, the additional data processing capability that is provided by the circuitry component 56 does not occupy any meaningful space within the interior region 40 yet is usable by the first and second accessories 50 and 52 that are situated within the first and second accessory cavities 44 and 46 and which are cooperable with other portions of the electrical apparatus 8 of the circuit interrupter 4. It is understood that other attachment methodologies may be employed to affix the circuitry component 56 to the molded case 6, such as with the use of threaded fasteners, clips, and the like without limitation.

In the depicted exemplary embodiment, the rear case portion 16 has a receptacle 98 formed therein adjacent the rear exterior surface 36 within which the main portion 72 is received when the circuitry component 56 is mounted to the molded case 6 using, the amount of adhesive 96. It is understood that mounting methodologies other than with the use of the amount of adhesive 96 can be employed without departing from the spirit of the instant disclosure.

The main portion 72 and the number of electronic components 60 that are received in the receptacle 98 typically will be of an overall thickness that is on the order of 0.047 to 0.060 inches in thickness, i.e., as measured in the direction of the depth of the receptacle 98 into the rear exterior surface 36. Depending upon the configuration of the rear case portion 16, the various electronic components of the number of electronic component 60 can be positioned on the substrate 58 as needed and electrically connected with the number of electrical conductors 68 in order to impart to the rear surface of the circuit interrupter 4 a flush surface that is receivable in an appropriate switchgear cabinet or other cabinet.

Figure 8:
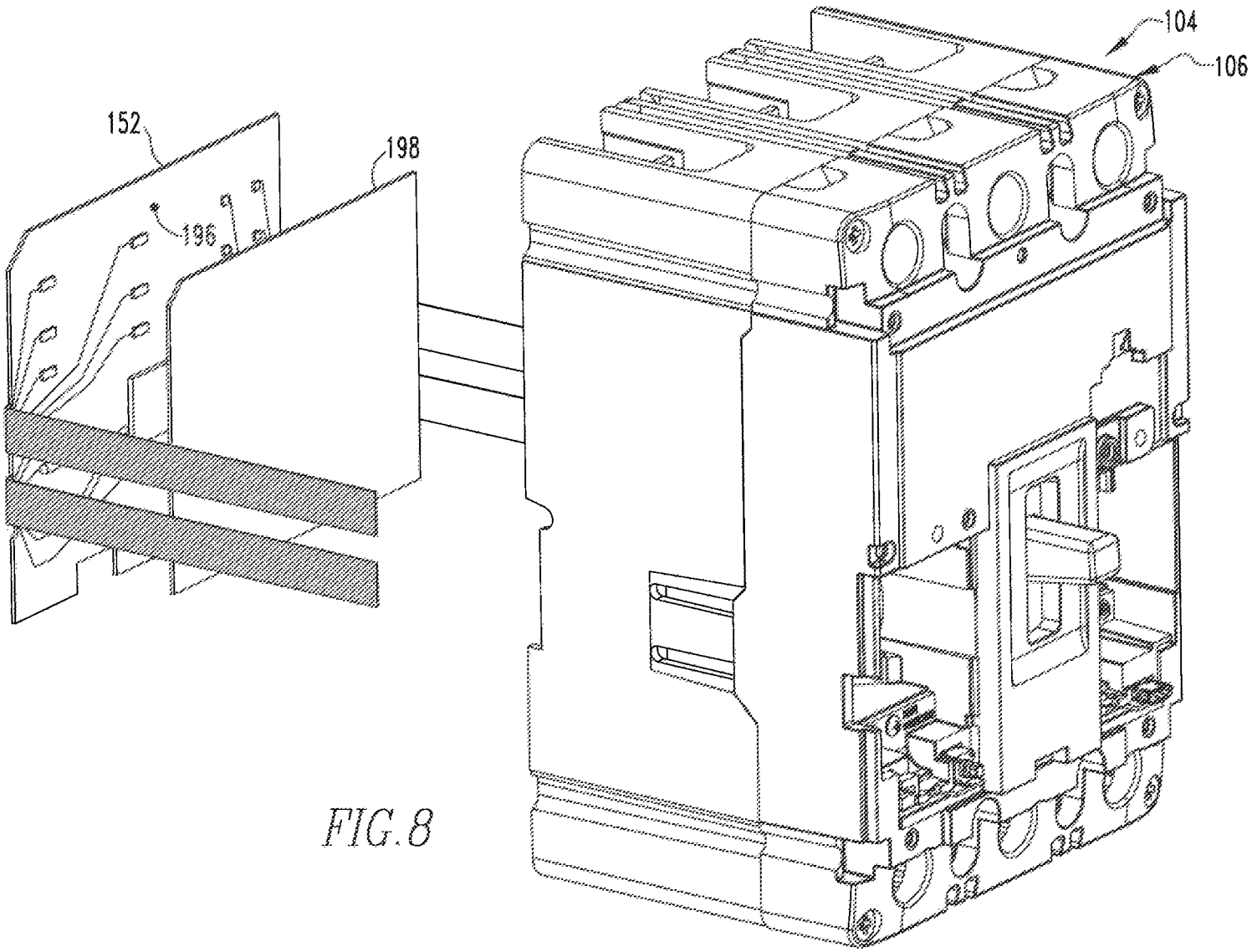
FIG. 8 is a partially exploded view of a circuit interrupter in accordance with a second embodiment of the disclosed and claimed concept.
Figure 9:
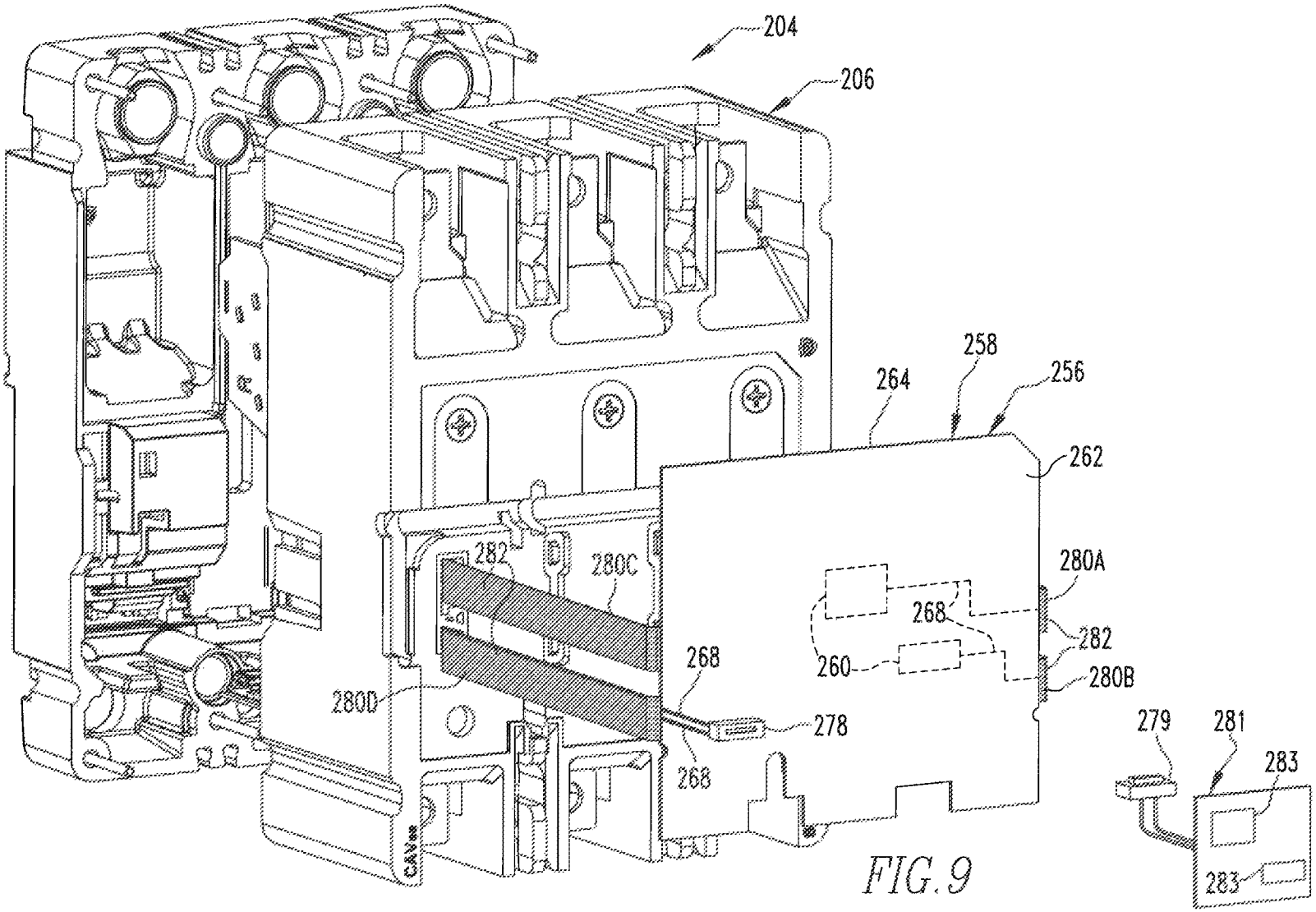
FIG. 9 is an exploded view of a circuit interrupter in accordance with a third embodiment f the disclosed and claimed concept.

An improved circuit interrupter 104 in accordance with a second embodiment of the disclosed and claimed concept is depicted generally in FIG. 8. The circuit interrupter 104 is similar to the circuit interrupter 4, except that the circuit interrupter 104 additionally includes an insulator 198 that is situated adjacent a molded case 106 of the circuit interrupter 104. Specifically, an amount of adhesive 196 affixes the insulator 198 to a substrate of a circuitry component 152 and thus to the molded ease 106, and the insulator 198 insulates the various electronic components that are situated on the circuitry component 152 from posts, fasteners, and other electrically conductive structures that might be situated on a rear case portion of the molded case 106. The circuitry component 152 and the insulator 198, as well as the amount of adhesive 196, will have a combined thickness that is no greater than about 0.060 inches or other appropriate thickness and impart to the circuit interrupter 104 a sufficiently low profile that the circuit interrupter 104 is receivable in a switchgear cabinet or other cabinet without difficulty. Furthermore, it is understood that the insulator 198 can be directly attached to the rear case portion of the molded case 106 such as by receiving the amount of adhesive 196 directly between the insulator 198 and the rear case portion rather than receiving the amount of adhesive 196 between the insulator 198 and the circuitry component 192, such as is depicted generally in FIG. 8. Other attachment methodologies may be employed to affix the circuitry component 152 and the insulator 198 to the molded case 106, such as with the use of threaded fasteners, clips, and the like without limitation. An improved circuit interrupter 204 in accordance with a third embodiment of the disclosed and claimed concept is depicted in a partially exploded state in FIG. 9. The circuit interrupter 204 is similar to the circuit interrupter 4, except that the circuit interrupter 204 includes a circuitry component 256 that is differently configured than the circuitry component 56. As noted elsewhere herein, the circuitry component 56 is a one-piece co-formed unit wherein the ribbon portion 76 and the main portion 72 are co-formed as a single piece unitary structure. In the circuitry component 256, the substrate 258 is formed separately from a number of ribbons 280A 280B, 280C, and 280D, which may be collectively or individually referred to herein with the numeral 280. In the depicted exemplary embodiment, the ribbons 280 are connected with the substrate 258 using a plurality of tiny connectors.

The circuitry component 256 includes a number of electronic components 260 that are situated on a support 264, with the support 264 additionally including a number of electrical conductors 268 that are electrically, connected with the number of electronic components 260. In the depicted exemplary embodiment, the substrate 258 may be, for example, a printed circuit board upon which the number of electronic components 260 are physically situated and with which the number of electronic components 260 are electrically connected, or it may be another type of structure, such as a flexible structure. The ribbons 280 extend from the substrate 258 and are connected therewith by the aforementioned connectors. The ribbons 280 include a number of additional electrical conductors 282 that are electrically connected with the number of electrical conductors 268 and thus are electrically connected with the number of electronic components 260 in order to electrically communicate the data operations that, are performed on the substrate 258 with accessories such as the first and second accessories 50 and 52 that are depicted in FIG. 3 as being used in conjunction with the circuit interupter 4.

Furthermore, the exemplary circuitry component 256 includes a connector 278 that is situated on a rear surface 262 of the support 264, i.e., the surface of the support 264 that faces generally away from a molded case 206 of the circuit interrupter 204 when the circuitry component 256 is installed on the molded case 206. The exemplary connector 278 thus likewise faces generally away from the molded case 206. A number of the electrical conductors 268 extend between the connector 278 and one or more of the ribbons 280 which, in the exemplary embodiment depicted in FIG. 9, include the ribbon 280D. It is understood, however, that the connector 278 could be situated anywhere else on the circuitry component 256 without departing from the spirit of the instant disclosure, and this can include situating the connector 278 on a frontal surface of the support or on an edge of the support 264, even if this involves removing a part of the molded case 206 in order to create space for the connector 278.

The connector 278 is advantageously connectable with a mating connector 279 of a customer device 281 that includes one or more other components 283 that are in data communication with the circuitry component 256. By way of example, the customer device 281 may be a switchgear cabinet to which the circuit interrupter 204 is mounted, and the mating connector 279 may be situated within a cavity of the switchgear cabinet. The other components 283 may be devices that are situated within the exemplary switchgear cabinet or elsewhere and may provide functionality, in whole or in part, for known technologies such ZSI, ARMS, ModbusRTU, CAMs, etc., by way of example and without limitation, as well as other technologies. Moreover, it is understood that the connector 278 could likewise be provided on either or both of the circuit interrupters 4 and 104 for similar data connection with the other components 283 or alternative components that can advantageously be placed in data communication with the circuit interrupters 4, 104, and 204.

It thus can be seen that the improved circuit interrupters 4, 104, and 204 each include a circuitry component that provides data processing capability that is performed at a location external to the circuit interrupter and that is provided to accessories and other devices that are situated internal to the circuit interrupter. This enables enhanced data processing capability that is usable by the circuit interrupter but that does not occupy the limited space that is available within the interior region of such circuit interrupter. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A molded case circuit interrupter comprising:

a molded case comprising a first case portion and a second case portion, the molded case having an interior region formed therein, that is situated between the first and second case portions;

an electrical apparatus situated on the molded case, the electrical apparatus comprising a set of separable electrical contacts situated within the interior region, a handle that is structured to at least initiate movement of the set of separable contacts between an OPEN condition and a CLOSED condition, and a circuitry component;

an accessory situated within the interior region and being structured to perform an operation, the molded case having an exterior surface opposite the interior region, the exterior surface comprising a front exterior surface and a rear exterior surface that face in opposite directions away from one another, the handle being situated adjacent the front exterior surface;

the circuitry component comprising a substrate situated at an exterior of the molded case circuit interrupter adjacent the rear exterior surface and further comprising a number of electronic components situated on the substrate, the number of electronic components being structured to provide a data processing capability that is electrically communicated to the accessory; and the substrate comprising a number of electrical conductors and a support; the number of electrical conductors being situated on the support, the support being formed of an electrically insulative material, at least some of the electronic components of the number of electronic components being electrically connected with at least some of the electrical conductors of the number of electrical conductors.

2. The molded case circuit interrupter of claim 1 wherein the substrate is affixed to the molded case.

3. The Molded case circuit interrupter of claim 2 wherein the circuitry component further comprises an amount of adhesive, at least a portion of the amount of adhesive being interposed between the substrate and the molded case and adhering the substrate to the molded case.

4. The molded case circuit interrupter of claim 1 wherein the molded case has a number of holes formed in at least one of the first ease portion and the second case portion, and wherein at least a subset of the electrical conductors of the number of electrical conductors extend through at least some of the holes of the number of holes.

5. The molded case circuit interrupter of claim 4 vherein the circuitry component further comprises a number of flexible ribbons that extend from the substrate and that comprise the at least subset, each flexible ribbon of the number of flexible ribbons having a length, a width, and a thickness, the length and width each being substantially greater than the thickness, the length being substantially greater than the width.

6. The molded case circuit interrupter of claim 1, wherein the molded case has a number of holes foliated in at least one of the first case portion and the second case portion, and wherein the circuitry component further comprises a number of additional electrical conductors that are electrically connected with one or more electrical conductors of the number of electrical conductors and that extend through at least some of the holes of the number of holes.

7. The molded case circuit interrupter of claim 1 wherein the circuitry component further comprises a number of insulators that are formed at least in part of an electrically insulative material and that are situated at least one of on the circuitry component and adjacent the circuitry component, at least some of the insulators each overlying at least one of an electronic component of the number of electronic components and an electrical conductor of the number of electrical conductors.

8. The molded case circuit interrupter of claim 7 wherein at least a subset of the at least some of the insulators are each affixed to at least one of the at least one of the electronic component and the electrical conductor.

9. The molded case circuit interrupter of claim 8 wherein the at least subset comprises an insulator of the at least some of the insulators and an amount of adhesive, the amount of adhesive affixing the insulator to the at least one of the electronic component and the electrical conductor.

10. The molded case circuit interrupter of claim 1 wherein the first case portion is a front case portion, the front exterior surface being on the front case portion, and wherein the second case portion is a rear case portion, the rear exterior surface being on the rear case portion.

11. The molded case circuit interrupter of claim 1 wherein the circuitry component comprises a printed circuit board, the printed circuit board comprising the substrate and the number of electrical conductors.

* * * * *